US006795753B2

(12) United States Patent
Vanderhoof et al.

(10) Patent No.: US 6,795,753 B2
(45) Date of Patent: Sep. 21, 2004

(54) COMPRESSOR CONTROL MODULE

(75) Inventors: Troy Inslee Vanderhoof, Plano, TX (US); Brian Douglas Cross, Double Oak, TX (US); John Michael Curry, Plano, TX (US); Carl Richard Reese, Carrollton, TX (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/238,544

(22) Filed: Sep. 10, 2002

(65) Prior Publication Data

US 2004/0049322 A1 Mar. 11, 2004

(51) Int. Cl.[7] ..... G06F 19/00
(52) U.S. Cl. ..... 700/301; 333/122
(58) Field of Search ..... 700/301; 333/122

(56) References Cited

U.S. PATENT DOCUMENTS 3,807,914 A * 4/1974 Paulson et al. ..... 425/144
3,840,312 A * 10/1974 Paulson et al. ..... 425/149
4,133,853 A * 1/1979 Ore et al. ..... 261/140.1
4,385,525 A * 5/1983 Phillips et al. ..... 73/720
4,553,474 A * 11/1985 Wong et al. ..... 454/74
4,602,324 A * 7/1986 Fujawa et al. ..... 700/1
4,788,871 A * 12/1988 Nelson et al. ..... 73/866.5
4,833,837 A * 5/1989 Bonneau ..... 52/2.19
5,192,152 A * 3/1993 Silvestri et al. ..... 400/679
5,631,632 A * 5/1997 Nakashima et al. ..... 340/611
6,223,645 B1 * 5/2001 Elberson ..... 91/31

OTHER PUBLICATIONS

"High Peak Power Test of S–Band Waveguide Switches"—A. Nassiri et al, 1998 IEEE.*

"Pressurized Antennas for Space Radars"—Thomas et al, 1980 American Institute of Aeronautics and Astronautics Inc.*

* cited by examiner

*Primary Examiner*—Leo Picard
*Assistant Examiner*—Michael D. Masinick
(74) *Attorney, Agent, or Firm*—Wood, Herron & Evans, LLP

(57) ABSTRACT

A compressor control module for use with a pressurization system having a strain gauge transducer and a compressor. The compressor control module includes variable voltage references associated with low and high pressure limits, comparator circuits configured to compare the voltage from the strain gauge pressure transducer to the variable voltage references, a control logic circuit configured to logically combine signals from the comparator circuits, and a relay circuit configured to apply power to the compressor.

46 Claims, 2 Drawing Sheets

COMPRESSOR CONTROL MODULE

FIELD OF THE INVENTION

This invention relates generally to pressurization systems, and more particularly to control of such systems.

BACKGROUND OF THE INVENTION

Generally, a pressurization system may be constructed using a compressor and a pressure switch. In such a system, the compressor is typically configured to pressurize a gas, such as air, or a liquid. The pressure switch is configured to measure the pressure created by the compressor and turn the compressor on and off to maintain a desired pressure. In certain applications, it may be desirable to accurately or precisely control the pressure provided by the pressurization system. An exemplary application of a precisely controlled pressurization system may be a pressurization system that provides dry pressurized air to an antenna housing or radome to prevent the ingress of contamination, such as moisture. Such precision pressurization systems are often desirable as the housings or radomes used on many antennas are often fragile and easy fractured.

One approach to controlling pressure from a compressor uses a diaphragm pressure switch. A diaphragm pressure switch generally includes a diaphragm, a spring supporting the diaphragm, and a set of electrical contacts coupled to the diaphragm. Pressurized air in the system presses against the diaphragm, opposing a bias from the spring. Once the pressure reaches a desired point, the electrical contacts are opened, de-energizing the compressor. Later, as pressure in the system decreases, the contacts are closed, re-energizing the compressor and thereby maintaining a constant pressure in the system.

Diaphragm pressure switches are not particularly well suited to accurately regulating pressure due to the spring force within such switches varying with temperature, vibration, and wear due to cyclical use. Sample-to-sample consistency of springs may also impart unacceptable variations in pressure. Further, diaphragm pressure switches tend to be sensitive to gravity or physical orientation; therefore, implementation of a diaphragm pressure switch may be critical in accurately controlling pressure.

Other approaches for regulating pressure in a pressurization system involve the use of strain gauge transducers and microprocessors. In these approaches, a transducer may be used to provide a voltage that varies in proportion to the pressure in the system created by a compressor. The variable voltage from the transducer is then processed either directly or indirectly, after an analog-to-digital conversion is performed, by a microprocessor to control the operation of the compressor, thereby maintaining a given pressure.

Approaches utilizing transducers have the advantage of regulating pressure accurately but are of limited utility due to the microprocessors used therewith. Often, pressurization systems are needed in applications where moisture, vibration, and power consumption are of concern. Pressurization systems incorporating microprocessors in such applications may be prone to failure, while requiring additional power. Moreover, the use of a microprocessor in a pressurization system may increase the cost of such a system, sometimes prohibitively so.

Therefore, it would be desirable to provide a pressurization system having accurate pressure sensing and reliability. It would be further desirable to achieve such accuracy and reliability with reduced cost and power consumption.

BRIEF DESCRIPTION OF THE DRAWINGS

The accompanying drawings, which are incorporated in and constitute a part of this specification, illustrate embodiments of the invention and, together with the detailed description given below, serve to explain the principles of the invention.

DETAILED DESCRIPTION OF THE DRAWINGS

Figure 1:
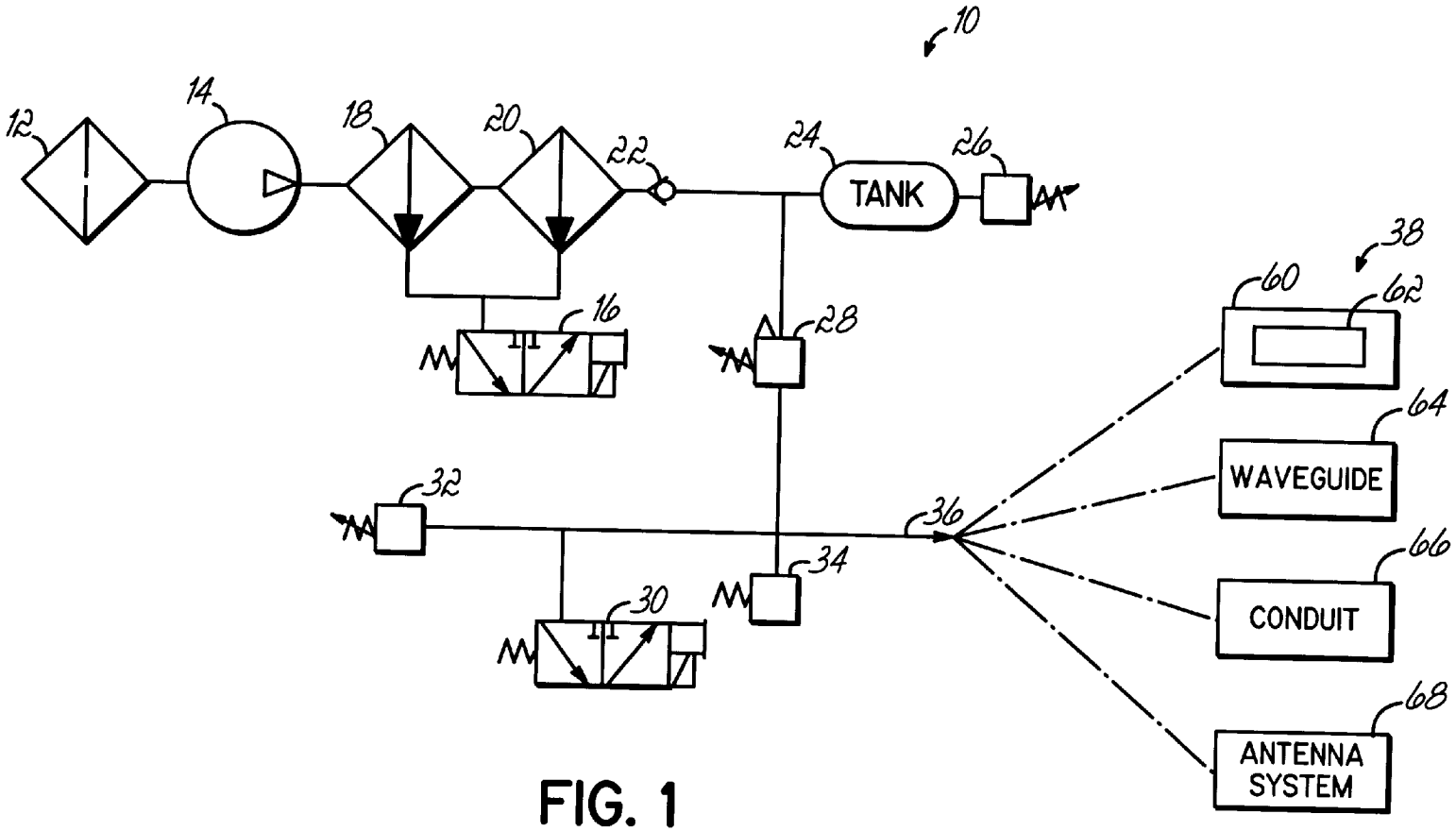
FIG. 1 is a pneumatic diagram of an embodiment of a pressurization system in accordance with the principles of the present invention; and, FIG. 2 is a schematic diagram of an embodiment of a compressor control module adapted for use with the pressurization system shown in FIG. 1 and consistent with the present invention.
Figure 2:
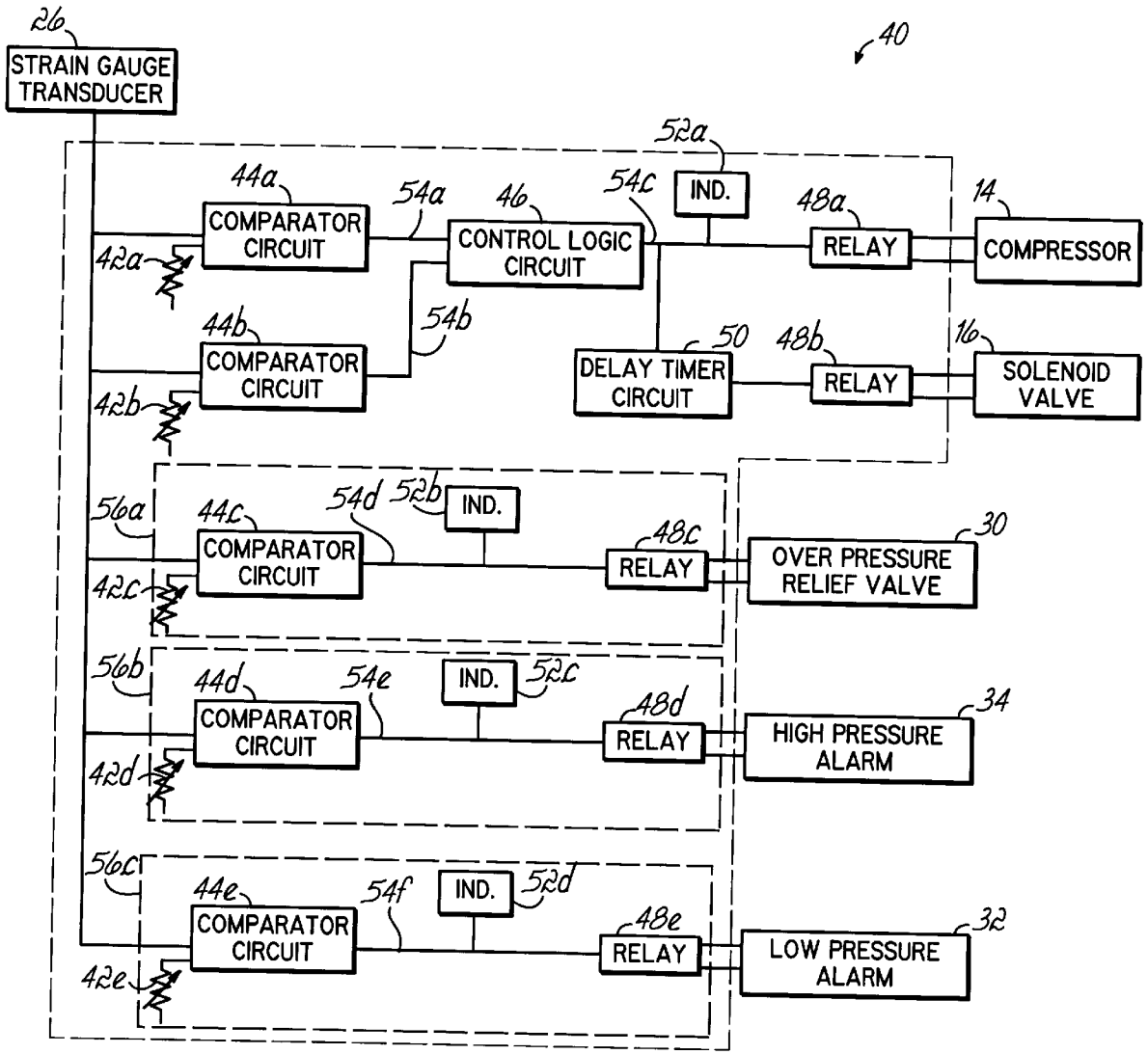

With reference to FIGS. 1 and 2, wherein like numerals denote like parts, there is shown a pressurization system 10 and a compressor control module 40 for use therewith that relies on a strain gauge transducer 26 to sense the pressure in the system 10 accurately and reliability with reduced cost and power consumption. More specifically, strain gauge transducer 26 provides a voltage that varies in proportion to the pressure in the system 10. The voltage is then compared to set points, (i.e., variable voltages), to control the operation of a compressor 14, and optionally provide additional controls and alarms.

Referring first to FIG. 1, a pneumatic diagram of an embodiment 10 of a pressurization system in accordance with principles of the present invention is illustrated. Pressurization system 10 comprises a compressor 14 coupled with a strain gauge transducer 26. Strain gauge transducer 26 exemplifies a transducer that provides a voltage that varies in proportion to pressure, as is well known in the art. Thus, as configured in system 10 and as shown in FIG. 1, the voltage provided by strain gauge transducer 26 varies in proportion to the pressure created in system 10 by compressor 14, the voltage being used to control the operation of compressor 14 as will be discussed hereinafter.

Strain gauge transducers are available in a number of standard pressure ranges from SenSym ICT, located at 1804 McCarthy Boulevard, Milpitas, Calif. 95035. Measurement Specialties, Inc., located at 80 Little Falls Road, Fairfield, N.J. 07004 also manufactures a number of standard pressure ranges, as well as custom pressure range, transducers. Those skilled in the art will appreciate that any one of these transducers, as well as others, may be used without departing from the spirit of the present invention.

System 10 may optionally include an intake air filter 12 coupled to the compressor 14. System 10 may further comprise one or more filters 18, 20, a check valve 22, a tank 24, and a pressure regulator 28, all of which are in fluid communication intermediate compressor 14 and strain gauge transducer 26. Solenoid valves 16, 30 and/or alarms 32, 34 may also be advantageously included as will also be discussed hereinafter.

As configured in FIG. 1, ambient air is drawn into system 10 through intake air filter 12 by compressor 14. The filtered intake air then flows downstream through filters 18 and 20. Filters 18 and 20 dry the intake air, the moisture in the intake air accumulating at the bottom of the filters 18, 20. Filters 18 and 20 may be coupled to a valve actuated by a solenoid 16 for purposes of draining the accumulated moisture from the filters 18, 20 as will be discussed hereinafter. The dry intake air then flows downstream through check valve 22 and into tank 24. Check valve 22 functions to prevent dry pressurized air in tank 24 from flowing upstream into filters 18 and 20 when compressor 14 is de-energized.

Compressor 14 builds pressure in tank 24, tank 24 functioning as a reservoir for dry pressurized air. When the pressure in tank 24 exceeds a given pressure associated with pressure regulator 28, pressure regulator 28 provides a source of accurately controlled dry pressurized air, as indicated at reference numeral 36. Such a source of accurately controlled dry pressurized air 36 may be used to prevent the ingress of moisture and other contaminants in pressure sensitive devices such as an antenna 38 having a housing or radome 60, the radome including a window 62. System 10 may also be used for waveguides 64, conduits or cable troughs 66 or antenna systems 68 with enclosed portions which are pressurized. Those skilled in the art will appreciate that pressurization system 10 may also be used for other applications requiring a source of accurately controlled dry pressurized air.

System 10 may advantageously include an over pressure relief valve 30. Over pressure relief valve 30 may be used to release pressure in system 10 to protect pressure sensitive components, such as a window in an antenna housing or radome, should an over pressure condition occur within system 10. System 10 may also advantageously include a low pressure alarm 32 and/or a high pressure alarm 34. Low pressure alarm 32 and high pressure alarm 34 may be used to provide indications of low and high pressure conditions in system 10. In FIG. 1, over pressure relief valve 30, low pressure alarm 32, and high pressure alarm 34 are shown downstream from pressure regulator 28; however, those skilled in the art will appreciate that any or all of an over pressure relief valve, low pressure alarm, and high pressure alarm may be located upstream from a pressure regulator without departing from the spirit of the present invention.

Referring now to FIG. 2, a schematic diagram of an embodiment 40 of a compressor control module adapted for use with pressurization system 10 shown in FIG. 1 and consistent with principles of the present invention is illustrated. Compressor control module 40 comprises variable voltage references 42*a–e*, comparator circuits 44*a–e*, control logic circuit 46, relays 48*a–e*, delay timer circuit 50 and indicators 52*a–e*.

To control the operation of compressor 14, compressor control module 40 uses variable voltage references 42*a*, 42*b*, comparator circuits 44*a*, 44*b*, control logic circuit 46, and relay 48*a*. Variable voltage reference 42*a* is associated with a low-pressure limit for pressurized air from compressor 14, and variable voltage reference 42*b* is associated with a high-pressure limit for the pressurized air. Comparator circuit 44*a* is coupled to strain gauge transducer 26 and variable voltage reference 42*a* and is configured to compare the voltage from strain gauge transducer 26 and variable voltage reference 42*a* and output a first logic signal 54*a* for energizing compressor 14. Similarly, comparator circuit 44*b* is coupled to the strain gauge transducer 26 and variable voltage reference 42*b* and is configured to compare the voltage from strain gauge transducer 26 and variable voltage reference 44*b* and output a second logic signal 54*b*. Control logic circuit 46 is coupled to comparator circuits 44*a* and 44*b* and is configured to logically combine the first and second logic signals 54*a*, 54*b* and provide a control signal 54*c*. Relay 48*a* is coupled to the control logic circuit 46 and is configured to apply power to the compressor 14 in response to the control signal 54*c*.

Control logic circuit 46 may include one or more logic gates or other suitable logic components configured to logically combine logic signals 54*a* and 54*b*, providing control signal 54*c*, for purposes of energizing compressor 14 when the pressure in system 10 is below the low pressure limit and de-energizing compressor 14 when the pressure in system 10 is above the high pressure limit. The one or more logic gates may be further configured to maintain the operational status, i.e., energized or de-energized, of compressor 14 should the pressure in system 10 be between the low and high pressure limits.

Such a configuration of logic gates will be readily apparent to those of skill in the art when faced with the design constraints associated with the selection of other components in system 10. Constraints may include, but are not limited to, the selection of the strain gauge transducer 26, the selection of the comparator circuits 44*a–e*, and the availability of devices or components within integrated circuits should integrated circuits be selected for comparators circuits 44*a–e* and/or variable voltage references 42*a–e*.

As configured in FIG. 2, indicator 52*a* is coupled to control logic circuit 46 and indicates the operational status of compressor 14. As mentioned hereinbefore and shown in FIG. 1, solenoid valve 16 may be used to drain moisture and contaminants from filters 18 and 20. As shown in FIG. 2, relay 48*b* is coupled to control logic circuit 46 and actuates solenoid valve 16 in response to control signal 54*c*. Delay timer circuit 50 coupled intermediate control logic circuit 46 and relay 48*b* may used to delay the application of control signal 54*c* to solenoid valve 16 thereby providing an opportunity for moisture to condense in filters 18 and 20 prior to being drained. Delay timer circuit 50 may be an integrated circuit timer such as a 555 timer/oscillator. Those skilled in the art will appreciate that other timers and/or oscillators may also be used without departing from the spirit of the present invention.

Control module 40 advantageously includes control circuits 56*a–c*. Each control circuit 56*a–c* comprises a respective variable voltage reference 42*c–e*, a comparator circuit 44*c–e*, and a relay 48*c–e*. Each control circuit 56*a–c* may further comprise a respective indicator 52*b–d*. The variable voltage references 42*c–e* may be associated with either an under pressure limit or an over pressure limit. As configured in FIGS. 1 and 2, variable voltage references 42*c* and 42*d* are associated with an over pressure limit, whereas variable voltage reference 42*e* is associated with an under pressure limit.

Comparator circuits 44*c–e* are coupled to strain gauge pressure transducer 26 and variable voltage references 42*c–e*, respectively. Comparator circuits 44*c–e* are configured to compare the voltage from strain gauge transducer 26 and the respective variable voltage reference 42*c–e* and output a respective logic signal 54*d–f*. Relays 48*c–e* are coupled respectively to comparator circuits 44*c–e* and include a set of switch contacts that operate in response to the respective logic signals 54*d–f*. Indicators 52*b–d* coupled to respective comparator circuits 44*c–e* indicate the state of the relay, such as the position of respective relay 48*c–e* switch contacts.

As shown in FIGS. 1 and 2, control circuit 56*a* is coupled to over pressure relief valve 30 for purposes of releasing pressure in system 10 in the event of an over pressure condition, variable voltage 42*c* corresponding to the pressure at which valve 30 opens. Control circuit 56*b* is coupled to a high pressure alarm 34, variable voltage reference 42*d* corresponding to the pressure at which the high pressure alarm occurs. Similarly, control circuit 56*c* is coupled to a low pressure alarm 32, variable voltage reference 42*e* corresponding to the pressure at which the low pressure alarm occurs.

Variable voltage references 44*a–e* may be provided using potentiometers, a resistor arrays, or digital-to-analog converters used with a series of switches, such as dual inline package (DIP) switches, or a processor. Those skilled in the art will appreciate that other devices providing a variable voltage may also be used without departing from the spirit of the present invention. Comparator circuits 44*a–e* may be differential amplifiers, operational amplifiers, or other devices capable of comparing two voltages and providing a logical output and known to those skilled in the art. Indicators 52*a–d* may be incandescent lamps, light emitting diodes (LEDs), or other indicators having similar functionality.

While the present invention has been illustrated by the description of the embodiments thereof, and while the embodiments have been described in considerable detail, it is not the intention of the applicants to restrict or in any way limit the scope of the appended claims to such detail. For example, it will be understood that a valve actuated by a solenoid for purposes of draining accumulated moisture from one or more filters, an over pressure relief valve configured to relieve pressure from a pressurization system should an over pressure condition occur within a system, and high and/or low pressure alarms and the circuitry associated therewith are all optional, and may be omitted from embodiments consistent with the present invention. Further, a strain gauge pressure transducer may be used to sense pressure in practically any pressurized region of a pressurization system. Moreover, multiple strain gauge pressure transducers may also be used to sense pressures in multiple regions of a pressurization system. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicants' general inventive concept.

What is claimed is:

1. A pressurization system having a strain gauge transducer, the pressurization system comprising:

a compressor configured for providing compressed air in an RF system;

a first variable voltage reference associated with a pressure limit for the pressurization system;

a first comparator circuit configured for coupling with a strain gauge transducer and the first voltage reference, the first comparator circuit operable to compare a voltage signal from the strain gauge pressure transducer and the first voltage reference and output a first logic signal;

a control logic circuit coupled to the first comparator circuit and operable to provide a control signal reflective of the first logic signal for controlling operation of the compressor.

2. The pressurization system of claim 1 further comprising a relay coupled to the control logic circuit and configured for applying power to the compressor in response to the control signal.

3. The pressurization system of claim 1, wherein the first voltage reference comprises a potentiometer.

4. The pressurization system of claim 1, wherein the first voltage reference comprises a resistor array.

5. The pressurization system of claim 1, wherein the first voltage reference comprises a digital-to-analog converter and at least one of a series of switches and a processor.

6. The pressurization system of claim 1, wherein the first comparator circuit comprises a differential amplifier.

7. The pressurization system of claim 1, wherein the first comparator circuit comprises an operational amplifier.

8. The pressurization system of claim 1, wherein the control logic circuit comprises an exclusive OR logic gate.

9. The pressurization system of claim 1, wherein the control logic circuit comprises a plurality of logic gates.

10. The pressurization system of claim 1, further comprising an indicator coupled to the control logic, the indicator indicating the operational status of the compressor.

11. The pressurization system of claim 1, wherein the pressurization system includes at least one filter coupled to a valve actuated by a solenoid, and a relay coupled to the control logic circuit and configured to actuate the solenoid in response to the control signal.

12. The pressurization system of claim 11, further comprising a delay timer circuit coupled intermediate the control logic circuit and the relay, the delay timer circuit configured to delay the application of the control signal to the solenoid.

13. The pressurization system of claim 12, wherein the delay timer circuit comprises an integrated circuit timer.

14. The pressurization system of claim 1 further comprising a second variable voltage reference associated with a high pressure limit for the compressor, the first variable voltage reference associated with a low pressure limit;

a second comparator circuit coupled to the strain gauge transducer and the second voltage reference, the second comparator circuit configured to compare the voltage from the strain gauge pressure transducer and the second voltage reference and output a second logic signal;

the control logic circuit coupled to the first and second comparator circuits and configured to logically combine the first and second logic signals and provide the control signal.

15. The pressurization system of claim 14, further comprising:

a third variable voltage reference associated with at least one of an under pressure limit and an over pressure limit;

a third comparator circuit coupled to the strain gauge transducer and the third variable voltage reference, the third comparator circuit configured to compare the voltage from the strain gauge transducer and the third variable voltage reference and output a second control signal; and a relay coupled to the third comparator circuit and operating in response to the second control signal.

16. The pressurization system of claim 15, further comprising an indicator coupled to the third comparator circuit, the indicator indicating a state of the relay.

17. The pressurization system of claim 15, wherein the pressurization system includes an over pressure relief valve with the third comparator relay being coupled to the over pressure relief valve.

18. The pressurization system of claim 15, wherein the relay drives at least one of an under pressure and over pressure alarm.

19. The pressurization system of claim 1, wherein the pressurization system is coupled to an antenna radome.

20. A pressurization system comprising:

a strain gauge transducer;

a compressor;

a first variable voltage reference associated with a pressure limit for the pressurization system;

a first comparator circuit coupled to the strain gauge transducer and the first voltage reference, the first comparator circuit configured to compare the voltage from the strain gauge pressure transducer and the first voltage reference and output a first logic signal;

a control logic circuit coupled to the first comparator circuit and operable to provide a control signal reflective of the first logic signal for controlling operation of the compressor;

a second variable voltage reference associated with a high pressure limit for the pressurization system, the first variable voltage reference associated with a low pressure limit;

a second comparator circuit coupled to the strain gauge transducer and the second voltage reference, the second comparator circuit configured to compare the voltage from the strain gauge pressure transducer and the second voltage reference and output a second logic signal;

the control logic circuit coupled to the first and second comparator circuits and configured to logically combine the first and second logic signals and provide the control signal.

21. The pressurization system of claim 20 further comprising a relay coupled to the control logic circuit and configured for applying power to the compressor in response to the control signal.

22. The pressurization system of claim 20, wherein the first voltage reference comprises one of a potentiometer and a resistor array.

23. The pressurization system of claim 20, wherein the first voltage reference comprises digital-to-analog converters and at least one of a series of switches and a processor.

24. The pressurization system of claim 20, wherein the first comparator circuit comprises one of differential and operational amplifiers.

25. The pressurization system of claim 20, further comprising an indicator coupled to the control logic circuit, the indicator indicating the operational status of the compressor.

26. The pressurization system of claim 20, further comprising:

a third variable voltage reference associated with at least one of an under pressure limit and an over pressure limit;

a third comparator circuit coupled to the strain gauge transducer and the third variable voltage reference, the third comparator circuit configured to compare the voltage from the strain gauge transducer and the third variable voltage reference and output a second control signal.

27. The pressurization system of claim 26, further comprising an alarm for indicating one of an over pressure limit and under pressure limit, the alarm operating in response to the second control signal.

28. The pressurization system of claim 26, further comprising over pressure relief valve for relieving pressure in the compressor, the over pressure relief valve operating in response to the second control signal.

29. The pressurization system of claim 20, wherein the pressurization system is configured for coupling with an antenna radome.

30. A pressurization system comprising:

a strain gauge transducer;

a compressor;

a first variable voltage reference associated with a pressure limit for the pressurization system;

a first comparator circuit coupled to the strain gauge transducer and the first voltage reference, the first comparator circuit configured to compare the voltage from the strain gauge pressure transducer and the first voltage reference and output a first logic signal; p1 a control logic circuit coupled to the first comparator circuit and operable to provide a control signal reflective of the first logic signal for controlling operation of the compressor;

wherein the pressurization system is configured for use with an antenna having a radome and a radome window.

31. The pressurization system of claim 20, wherein the pressurization system is configured for use with a waveguide.

32. The pressurization system of claim 20, wherein the pressurization system is configured for use with a conduit.

33. An antenna system comprising:

an antenna having an enclosed portion to be pressurized;

a compressor operably coupled to the antenna for pressurizing the enclosed portion;

a strain gauge transducer operably coupled to the determine a pressure for the system;

a first variable voltage reference associated with a pressure limit for the system;

a first comparator circuit coupled to the strain gauge transducer and the first voltage reference, the first comparator circuit configured to compare the voltage from the strain gauge pressure transducer and the first voltage reference and output a first logic signal;

a control logic circuit coupled to the first comparator circuit and operable to provide a control signal reflective of the first logic signal for controlling operation of the compressor to maintain the pressure of the antenna system.

34. An RF system comprising:

a conduit coupling electrical components of the RF system;

a compressor operably coupled to the conduit for pressurizing the conduit;

a strain gauge transducer operably coupled to the determine a pressure for the RF system;

a first variable voltage reference associated with a pressure limit for the RF system;

a first comparator circuit coupled to the strain gauge transducer and the first voltage reference, the first comparator circuit configured to compare the voltage from the strain gauge pressure transducer and the first voltage reference and output a first logic signal;

a control logic circuit coupled to the first comparator circuit and operable to provide a control signal reflective of the first logic signal for controlling operation of the compressor to maintain the pressure of the RF system.

35. An RF system comprising:

a waveguide coupling electrical components of the RF system;

a compressor operably coupled to the waveguide for pressurizing the waveguide;

a strain gauge transducer operably coupled to the determine a pressure for the RF system;

a first variable voltage reference associated with a pressure limit for the RF system;

a first comparator circuit coupled to the strain gauge transducer and the first voltage reference, the first comparator circuit configured to compare the voltage from the strain gauge pressure transducer and the first voltage reference and output a first logic signal;

a control logic circuit coupled to the first comparator circuit and operable to provide a control signal reflective of the first logic signal for controlling operation of the compressor to maintain the pressure of the RF system.

36. A method of controlling the pressure in an RF system, the method comprising:

providing compressed air to the RF system with a compressor;

comparing a voltage signal from a strain gauge pressure transducer with a first variable voltage reference associated with a pressure limit for the RF system and outputting a first logic signal;

based on such comparison and the first logic signal, generating a control signal; and, selectively energizing or de-energizing the compressor in response to the control signal.

37. The method of claim 36, further comprising:

comparing the voltage from the strain gauge pressure transducer with a second variable voltage reference associated with a high pressure limit for the pressurization system to output a second logic signal, the first variable voltage reference associated with a low pressure limit;

with a control logic circuit, logically combining the first and second logic signals and generating the control signal.

38. The method of claim 37 further comprising setting at least one of the first and second variable voltage references in response to a user input.

39. The method of claim 36 further comprising:

comparing a voltage signal from the strain gauge pressure transducer with another variable voltage reference associated with a pressure limit for the pressurization system;

based on such comparison, operating an over pressure relief valve to relieve an over pressure condition in the system.

40. The method of claim 36 further comprising:

comparing a voltage signal from the strain gauge pressure transducer with another variable voltage reference associated with a pressure limit for the pressurization system;

based on such comparison, generating an alarm indicative of one of an over pressure condition and an under pressure.

41. A method for pressurizing at least one of a conduit or a waveguide in an RF system comprising:

coupling a compressor to the RF system;

comparing a voltage signal from a strain gauge pressure transducer with a first variable voltage reference associated with a pressure limit for the RF system and outputting a first logic signal;

based on such comparison and the first logic signal, generating a control signal; and, selectively energizing or de-energizing the compressor in response to the control signal.

42. A method for pressurizing an antenna system comprising:

coupling a compressor to the antenna system;

comparing a voltage signal from a strain gauge pressure transducer with a first variable voltage reference associated with a pressure limit for the antenna system and outputting a first logic signal;

based on such comparison and the first logic signal, generating a control signal; and, selectively energizing or de-energizing the compressor in response to the control signal.

43. A control module configured for use with a pressurization system having a strain gauge transducer and a compressor, the control module comprising:

a first variable voltage reference associated with a low pressure limit for the pressurization system;

a first comparator circuit configured for coupling with a strain gauge transducer and the first voltage reference, the first comparator circuit operable to compare a voltage signal from the strain gauge pressure transducer and the first voltage reference and output a first logic signal;

a second variable voltage reference associated with a high pressure limit for the pressurization system;

a second comparator circuit coupled to the strain gauge transducer and the second voltage reference, the second comparator circuit configured to compare the voltage from the strain gauge pressure transducer and the second voltage reference and output a second logic signal;

a control logic circuit coupled to the first and second comparator circuits and configured to logically combine the first and second logic signals and provide a control signal for controlling operation of the compressor;

a third variable voltage reference associated with at least one of an under pressure limit and an over pressure limit;

a third comparator circuit coupled to the strain gauge transducer and the third variable voltage reference, the third comparator circuit configured to compare the voltage from the strain gauge transducer and the third variable voltage reference and output a second control signal; and a relay coupled to the third comparator circuit and operating in response to the second control signal.

44. The control module of claim 43, further comprising an indicator coupled to the third comparator circuit, the indicator indicating a state of the relay.

45. The control module of claim 43, wherein the pressurization system includes an over pressure relief valve with the third comparator relay being coupled to the over pressure relief valve.

46. The control module of claim 43, wherein the relay drives at least one of an under pressure and over pressure alarm.

* * * * *